US005388717A

United States Patent [19]

LeVasseur

[11] Patent Number: 5,388,717

[45] Date of Patent: Feb. 14, 1995

[54] VENTED TRASH CAN

[76] Inventor: Jon P. LeVasseur, 1997 Esterbrook St., Port St. Lucie, Fla. 34983-469

[21] Appl. No.: 161,589

[22] Filed: Dec. 6, 1993

[51] Int. Cl.[6] ..... B65D 90/04

[52] U.S. Cl. ..... 220/404; 220/676; 220/730; 220/745; 220/908

[58] Field of Search ..... 220/404, 676, 730, 745, 220/908

[56] References Cited

U.S. PATENT DOCUMENTS

| | | | |
|---|---|---|---|
| 1,218,632 | 3/1917 | Derry | 220/404 X |
| 1,344,802 | 6/1920 | Lackner | 220/404 |
| 2,533,524 | 12/1950 | Snider | 220/404 X |
| 3,074,583 | 1/1963 | Martinich, Jr. | 220/908 X |
| 3,342,368 | 9/1967 | Matry | 220/908 X |
| 4,416,197 | 11/1983 | Kehl | 220/908 X |
| 4,991,500 | 2/1991 | Knapp | 220/908 X |
| 5,031,796 | 7/1991 | Schäfer et al. | 220/908 X |
| 5,156,290 | 10/1992 | Rodrigues | 220/908 X |
| 5,242,074 | 9/1993 | Conaway et al. | 220/254 |

FOREIGN PATENT DOCUMENTS

| | | | |
|---|---|---|---|
| 2232341 | 12/1990 | United Kingdom | 220/908 |

*Primary Examiner*—Gary E. Elkins
*Assistant Examiner*—Stephen Cronin
*Attorney, Agent, or Firm*—Michael I. Kroll

[57] ABSTRACT

A vented trash can is provided, which consists of a container having an open top for the insertion and removal of a plastic trash bag. A component is for allowing air to enter the container under the plastic trash bag when removing the plastic trash bag from the container. The normal vacuum in the container is now broken and the plastic trash bag can slide out rather than be suctioned against the inside of the container.

1 Claim, 1 Drawing Sheet

VENTED TRASH CAN

BACKGROUND OF THE INVENTION

1. Field of the Invention

The instant invention relates generally to garbage receptacles and more specifically it relates to a vented trash can for an easy removal of a full plastic trash bag therefrom.

2. Description of the Prior Art

Numerous garbage receptacles have been provided in prior art that are adapted to hold plastic bags which when filled with garbage, are difficult to be removed from the receptacles. While these units may be suitable for the particular purpose to which they address, they would not be as suitable for the purposes of the present invention as heretofore described.

SUMMARY OF THE INVENTION

A primary object of the present invention is to provide a vented trash can that will overcome the shortcomings of the prior art devices.

Another object is to provide a vented trash can in which a port is formed within one side wall adjacent a bottom wall of a container, so that a plastic trash bag can be inserted empty and removed full from the container without interference from a vacuum otherwise created therein.

An additional object is to provide a vented trash can in which a grille is installed within the port, to prevent the entrance of rodents and other small animals through the port and into the plastic trash bag.

A further object is to provide a vented trash can that is simple and easy to use.

A still further object is to provide a vented trash can that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
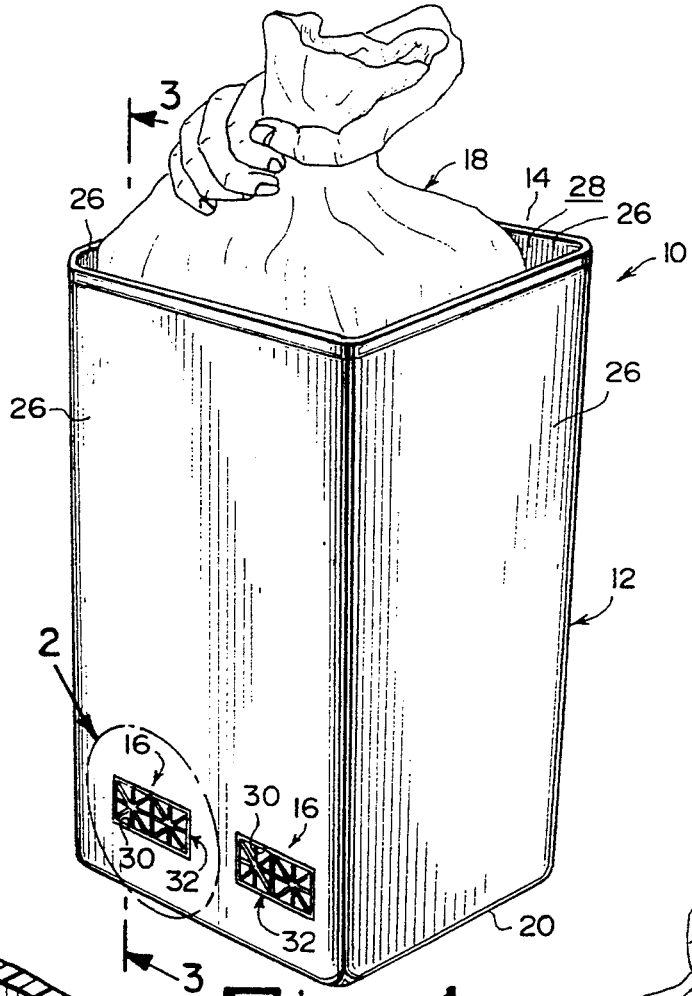
FIG. 1 is a perspective view of the instant invention.
Figure 2:
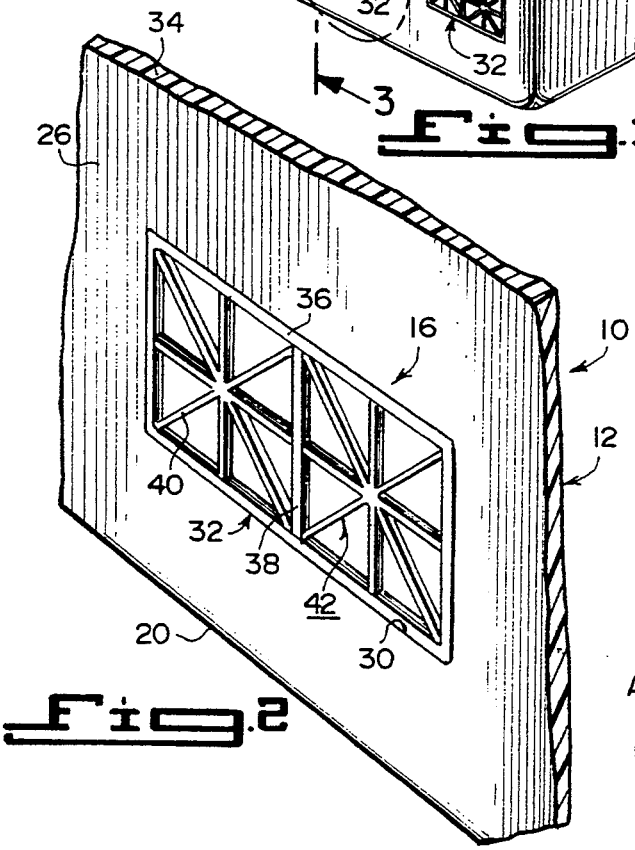
FIG. 2 is an enlarged perspective view of one of the ports as indicated by arrow 2 in FIG. 1.
Figure 3:
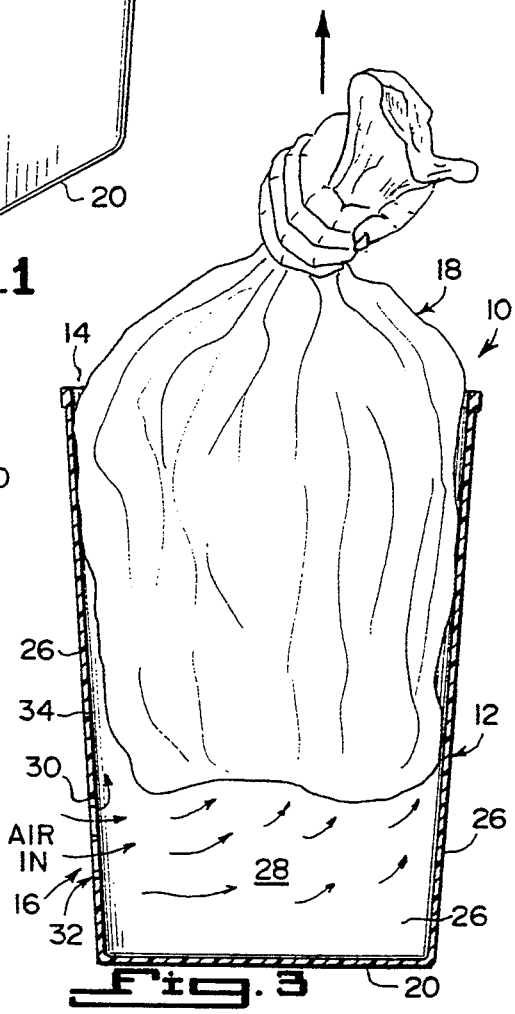
FIG. 3 is a cross sectional view taken along line 3—3 in FIG. 1.

Turning now descriptively to the drawings, in which similar reference characters denote similar elements throughout the several views, FIGS. 1 through 3 illustrate a vented trash can 10, which consists of a container 12 having an open top 14 for the insertion and removal of a plastic trash bag 18. A component 16 is for allowing air to enter the container 12 under the plastic trash bag 18, when removing the plastic trash bag 18 when full from the container 12. The normal vacuum in the container 12 is now broken and the plastic trash bag 18 can slide out rather than be suctioned against the inside of the container 12.

The container 12 includes a bottom wall 20, and a plurality of side walls 26 extending upwardly from the bottom wall 20, to form a compartment 28 within the container 12 for holding the plastic trash bag 18 therein.

All of the side walls 26 are angled outwardly from the bottom wall 20. The open top 14 of the container 12 is larger than the bottom wall 20, to permit the easier insertion of the plastic trash bag 18 into the compartment 28 of the container 12 and the easier removal of the plastic trash bag 18 from the compartment 28 of the container 12.

The air allowing component 16 is a port 30 formed within one of the side walls 26 adjacent to the bottom wall 20 of the container 12. A grille 32 is provided, to fit into and cover the port 30, to prevent the entrance of rodents and other small animals through the ports 30 and into the plastic trash bag 18.

The port 30 is generally rectangular in shape, while the grille 32 is also generally rectangular in shape and is of a size to fit into the rectangular shaped port 30.

The side walls 26 and the bottom wall 20 of the container 12 are integral and fabricated out of a strong durable material 34. The grille 32 is also fabricated out of strong durable material 34, which can be plastic, metal and similar materials.

The grille 32, as best seen in FIG. 2, includes a plurality of horizontal bars 36, a plurality of vertical bars 38 and a plurality of diagonal bars 40, all intersecting each other to form a lattice pattern 42 for the grille 32.

FIGS. 1 and 2 show two ports 30 and two grilles 32 in the side wall 26. The vented trash can 10 can also function just as well with one port 30 and grille 32, as described above, to brake the vacuum under the plastic trash bag 18 in the container 12.

OPERATION OF THE INVENTION

To use the vented trash can 10, the following steps should be taken:

1. Put the container 12 onto a flat horizontal surface, so that the port 30 is not obstructed.
2. Insert the grille 32 into the port 30 in the side wall 26 of the container 12.
3. Place the empty plastic trash bag 18 through the open top 14 and into the compartment 28 of the container 12, so that the bottom of the plastic bag 18 rests upon the bottom wall 20.
4. Fill up the plastic trash bag 18 with trash.
5. Pull the full plastic trash bag 18 out of the container 12, so that air will enter past the grilles 32 in the port 30 and go into the compartment 28 under the plastic trash bag 18.
6. Since the vacuum is broken, the full plastic trash bag 18 will now easily slide out of the container 12 with little effort.

Typical dimensions of the vented trash can 10, but not limited thereto, are as follows:

1. The height of each side wall 26 of the container 12 is approximately twenty three inches.
2. The width and depth of the open top 14 of the container 12 is approximately fifteen inches in each direction.
3. The width and depth of the bottom wall 20 of the container 12 is approximately twelve inches in each direction.
4. The distance of the lower edge of the port 30 in the side wall 26 from the bottom wall 20 is approximately one inch.

5. The size of the port 30 is approximately one inch in height and two inches in length.
6. The size of the grille 32 is approximately one inch in height and two inches in length, so that it can fit snugly into the port 30.

LIST OF REFERENCE NUMBERS

10 vented trash can
12 container
14 open top of 12
16 air allowing component
18 plastic trash bag
20 bottom wall of 12
26 side wall of 12
28 compartment in 12
30 port in 26
32 grille for 30
34 strong durable material
36 horizontal bar in 32
38 vertical bar in 32
40 diagonal bar in 32
42 lattice pattern for 32

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A vented trash can which comprises:

a) a container having an open top for the insertion and removal of a plastic trash bag;

b) said container comprising a bottom wall and a plurality of side walls extending upwardly from said bottom wall, to form a compartment within said container for holding the plastic trash bag of trash therein, all of said side walls being angled outwardly from said bottom wall, so that the open top of said container is larger than said bottom wall, to permit the easier insertion of the plastic trash bag into the compartment of said container and the easier removal of the plastic trash bag from the compartment of said container;

c) means for allowing air to enter said container under the plastic trash bag when removing the plastic trash bag when full from said container comprising a generally rectangular port formed within one of said side walls adjacent to said bottom wall of said container, said port being fitted with a rectangular grill having a plurality of horizontal, vertical and diagonal bars all intersecting each other to form a lattice pattern to cover said port to prevent the entrance of rodents and other small animals through said ports and into the plastic trash bag whereas the normal vacuum in said container is now broken and the plastic trash bag can slide out rather than be suctioned against the inside of said container; and c) said side and bottom walls are integral and fabricated out of a strong durable material and said grill is also fabricated out of a strong durable material.

* * * * *